US006357078B1

(12) United States Patent
Marzolf et al.

(10) Patent No.: US 6,357,078 B1
(45) Date of Patent: Mar. 19, 2002

(54) HOLD OPEN ASSEMBLY FOR MOVABLE CLOSURE

(75) Inventors: Ricci L. Marzolf, New Hampton, IA (US); Bruce E. Kallevig, Monticello; Bruce E. Frohman, Robbinsdale, both of MN (US); Craig J. Helton, New Hampton, IA (US)

(73) Assignee: Tri/Mark Corporation, New Hampton, IA (US)

( * ) Notice: Subject to any disclaimer, the term of this patent is extended or adjusted under 35 U.S.C. 154(b) by 0 days.

(21) Appl. No.: 09/594,913

(22) Filed: Jun. 15, 2000

(51) Int. Cl.[7] ..... E05F 5/02

(52) U.S. Cl. ..... 16/82; 16/86 B; 16/85; 16/DIG. 17; 292/341.15; 292/DIG. 15

(58) Field of Search ..... 16/82, 86 B, 85, 16/DIG. 17, DIG. 21; 292/341.15, 341.12, 354, 355, 340, 341, DIG. 15, DIG. 30; 49/319, 364, 379

(56) References Cited

U.S. PATENT DOCUMENTS 2,914,792 A * 12/1959 Campbell, Jr. ..... 16/82
4,071,129 A 1/1978 Crabb
4,159,138 A * 6/1979 Smith ..... 292/341.15
4,315,646 A 2/1982 McReynolds
5,628,600 A 5/1997 Pasquini
5,655,798 A 8/1997 Kaveney et al.
5,836,049 A * 11/1998 Chiang ..... 16/82
6,082,787 A * 7/2000 Chioffi et al. ..... 292/341.15
6,149,213 A * 11/2000 Sokurenko et al. ..... 292/340

* cited by examiner

*Primary Examiner*—Chuck Y. Mah
(74) *Attorney, Agent, or Firm*—Wood, Phillips, VanSanten, Clark & Mortimer

(57) ABSTRACT

An assembly for releasably holding a movable closure element in a desired position relative to a support. The holding assembly has a first part with a first element and a first actuator and a second part with a second element and a second actuator. The first part is connectable to a closure element, with the second part connectable to a support for the closure element. At least one of the first and second elements is movable relative to a support and/or closure element to which the at least one of the first and second elements is connected to allow the first and second elements to act, one against the other, so that the first and second elements realize a holding position as a closure element to which the first part is connected is moved towards and into the desired position. The first actuator is operable to move the at least one of the first and second elements relative to a support and/or closure element to which the at least one of the first and second elements is connected to a release position wherein a closure element to which the first part is connected can be moved from the desired position. The second actuator is operable to move the at least one of the first and second elements relative to a support and/or closure element to which the at least one of the first and second elements is connected to the release position wherein a closure element to which the first part is connected can be moved from the desired position.

20 Claims, 4 Drawing Sheets

HOLD OPEN ASSEMBLY FOR MOVABLE CLOSURE

BACKGROUND OF THE INVENTION

1. Field of the Invention

This invention relates to a hold open assembly to releasably maintain a closure element in an open position and, more particularly, to a hold open assembly that can be actuated from two different locations to release the closure element.

2. Background Art

Closure elements are used in a wide range of environments. In one such environment, on equipment in the agricultural industry, it is known to provide a hold open assembly to releasably maintain a closure element on a vehicle cab in an open position. This allows the operator of the equipment to positively maintain the closure element in a position wherein it will not interfere with the operator as he/she enters and exits an access opening on the cab which can be selectively blocked by the closure element. This arrangement also allows the operator to operate the equipment with the door positively maintained in the open position without fear that the door might freely swing during operation.

When the operator desires to close the closure element, the operator must release the closure element from the hold open assembly. This normally requires that the operator release the hold open assembly from an exterior location, which requires that the operator either reach around to the vicinity of the hold open assembly to effect release thereof or access the hold open assembly by stepping out of the vehicle to gain access to the hold open assembly. This is not only inconvenient, but may be awkward, or even dangerous, for the operator to carry out.

SUMMARY OF THE INVENTION

In one form, the invention is directed to an assembly for releasably holding a movable closure element in a desired position relative to a support. The holding assembly has a first part with a first element and a first actuator and a second part with a second element and a second actuator. The first part is connectable to a closure element, with the second part connectable to a support for the closure element. At least one of the first and second elements is movable relative to a support and/or closure element to which the at least one of the first and second elements is connected to allow the first and second elements to act, one against the other, so that the first and second elements realize a holding position as a closure element to which the first part is connected is moved towards and into the desired position. The first actuator is operable to move the at least one of the first and second elements relative to a support and/or closure element to which the at least one of the first and second elements is connected to a release position wherein a closure element to which the first part is connected can be moved from the desired position. The second actuator is operable to move the at least one of the first and second elements relative to a support and/or closure element to which the at least one of the first and second elements is connected to the release position wherein a closure element to which the first part is connected can be moved from the desired position.

In one form, the first actuator has a first graspable knob that is pivotable about a first axis relative to a closure element to which the first part is connected to move the first element from the holding position to the release position.

The first graspable knob and first element may be pivotable as one piece around the first axis relative to a closure element to which the first part is connected.

In one form, the first element is biasably urged toward the holding position.

The first part may further include a first mounting plate which is fixedly attachable to the closure element, with there additionally being a spring which acts between the first element and first mounting plate to bias the first element towards the holding position.

The holding assembly may further include a guide element on one of the first and second parts for guiding the one of the first and second elements on the other of the first and second parts on the other of the first and second elements against the other of the first and second elements on the one of the first and second parts.

The guide element may include an annular portion, which may include a tapered guide surface.

In one form, the second actuator has a graspable knob that is pivotable about a first axis to move the second element from the holding position to the release position.

The graspable knob and second element may be pivotable as one piece around the first axis relative to a support to which the second part is connected.

In one form, the second actuator includes a second graspable knob that is pivotable about an axis that is coincident with the first axis with a closure element to which the first part is connected in the desired position.

In one form, there is a first shoulder on the first knob and a second shoulder on the first mounting plate and the first and second shoulders cooperate to limit relative pivoting between the first knob and first mounting plate.

In one form, the first knob has an undercut that defines the first shoulder.

One of the first and second elements may include a spiral cam surface that extends around the first axis.

In one form, the first element has a first shoulder facing axially relative to the first axis and the second element has a second shoulder facing axially relative to the first axis and oppositely to the first shoulder. With the first and second elements in a holding position, the first and second shoulders are abuttable to each other to limit relative axial movement of the first and second elements away from each other.

In one form, there is a first cam surface on the first element and a second cam surface on the second element and the first and second cam surfaces cooperate as a closure element to which the first part is connected moves towards the desired position to pivot at least one of the first and second elements about an axis so that the first and second elements are relatively positioned to allow the first and second shoulders to move past each other.

The invention is also directed to an assembly for releasably holding a movable closure element in a desired position relative to a support, which holding assembly includes a first part and a second part. The first part has a first element and a first actuator and is connectable to a closure element. The second part has a second element and a second actuator and is connectable to a support relative to which a closure element to which the first part is connected is movable. At least one of the first and second elements is movable relative to a support and/or closure element to which the at least one of the first and second elements is connected so that the first and second elements realize a holding position. The first actuator is operable to move the at least one of the first and second elements relative to a support and/or closure element to which the at least one of the first and second elements is connected to a release position wherein a closure element to which the first part is connected can be moved from the desired position. The second actuator is operable to move the at least one of the first and second elements relative to a support and/or closure element to which the at least one of the first and second elements is connected to the release position wherein a closure element to which the first part is connected can be moved from the desired position.

The first and second actuators may each be a graspable knob that is pivotable about an axis.

The invention is also directed to the combination of a support, a closure element that is selectively movable relative to the support between a closed position and an open position, and a holding assembly as described above.

The first and second actuators may each include a graspable knob that is pivotable about an axis.

DETAILED DESCRIPTION OF THE DRAWINGS

Figure 1:
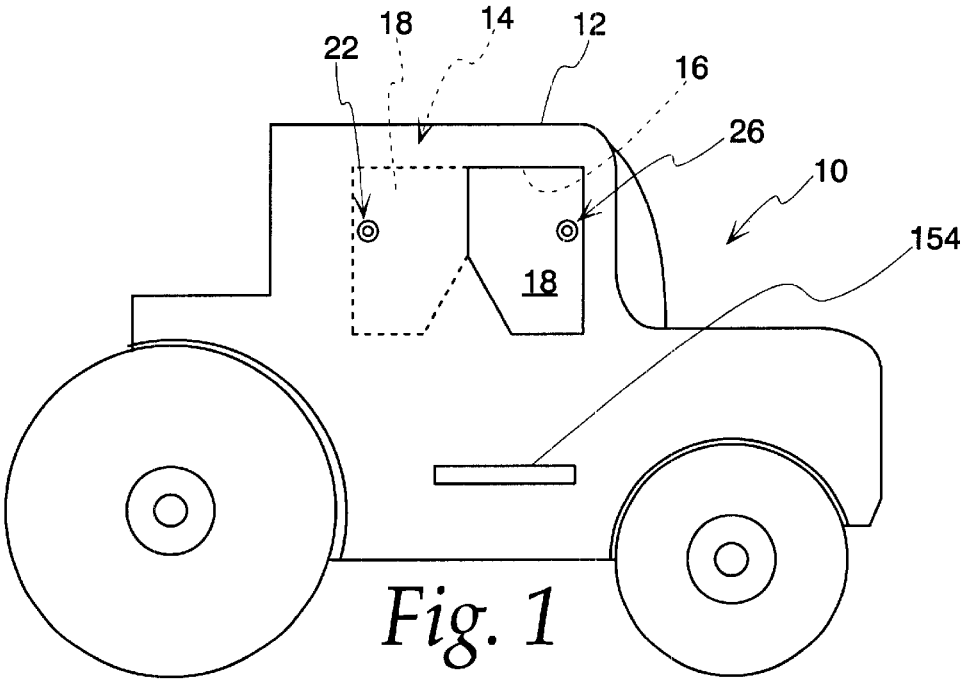
FIG. 1 is a side elevation view of an agricultural type vehicle with a movable closure element thereon incorporating a holding assembly, according to the present invention, for maintaining the closure element in an open position.

In FIG. 1, an agricultural vehicle is shown at 10 as one suitable environment for incorporation of the present invention. More specifically, the vehicle 10 has a frame/support 12 defining an interior operator's compartment 14. The compartment 14 is accessed through an opening 16. A closure element 18 is mounted to the frame/support 12 for pivoting movement between an open position, as shown in phantom lines in FIG. 1, wherein the opening 16 is exposed, and a closed position, shown in solid lines in FIG. 1.

The vehicle 10 incorporates a holding assembly, as shown at 20 in FIGS. 1–10, which is useable to releasably maintain the closure element 18 in the open position therefor. The holding assembly 20, which is described in detail below, is useable in virtually any environment in which a closure element is movable to any desired position relative to a support and in which the desired position is to be releasably maintained by the holding assembly 20.

The holding assembly 20 consists of a first part 22 which is fixedly connected to the frame/support 12 through fasteners 24, and a second part 26 which is fixedly connected to the closure element 18 through fasteners 28. The first part 22 has a first movable element 30 which cooperates with a second movable element 32 on the second part 26 to releasably maintain the closure element 18 in the open position therefor. The details of the first and second parts 22, 26 will now be described before their interaction is more fully explained.

As seen most clearly in FIGS. 2–5 and 10, the first part 22 consists of an actuator 34, in the form of a graspable knob, a mounting plate 36, a torsion spring 38, a rubber shroud 40, and the first movable element 30. The first movable element 30 has a bifurcated end with cantilevered legs 42, 44 which are dimensioned to fit within a complementary, blind receptacle 46 in the graspable knob 34. Diametrically opposite lugs 48, 50 project into the receptacle 46 and are configured to cooperate, one each with ramped, leading edges 52, 54 on the legs 42, 44 to progressively cam the legs 42, 44 towards each other as the legs 42, 44 are pressed into the receptacle 46. With the legs 42, 44 fully seated, locking edges 56, 58 on the legs 42, 44 move past the ends 60 (one shown) of the lugs 48, 50, whereupon the legs 42, 44 spring back towards an undeformed state to make a snap fit connection. The locking edges 56, 58 abut to the lug ends 60 to prevent withdrawal of the first movable element 30 from the receptacle 46. The squared arrangement of the legs 42, 44 and complementary receptacle 46 key the first element 30 and graspable knob 34 so that they are rotatable as one piece around a central operating axis 62.

The graspable knob 34 and first movable element 30 are assembled so as to captively maintain the mounting plate 36 and shroud 40 captively between an axially facing surface 64 on an enlarged flange 66 on the first movable element 30 and an annular edge 68 on the graspable knob 34. The first movable element 30 and graspable knob 34 are relatively dimensioned so that with the first movable element 30 snap fit to the graspable knob 34, the plate 36 is rotatable relative to the graspable knob 34 and first part 30 around the axis 62.

The graspable knob 34 has an annular, blind receptacle 70 which receives the torsion spring 38. The torsion spring 38 is a coil spring with one projecting end 74 extendable into an opening 76 on the knob 34 and an opposite projecting end 78 extending into an opening 80 in the mounting plate 36. Through this arrangement, the spring 38 can be preloaded to urge the mounting plate 36 relative to the graspable knob 34 in the direction of the arrow 82 around the axis 62.

The range of relative pivoting between the mounting plate 36 and graspable knob 34 is dictated by circumferentially spaced shoulders 84, 86 defined by an undercut 88 in the external surface 90 of the graspable knob 34. The mounting plate 36 has a tab 92 which moves within the undercut 88. The tab 92 defines spaced shoulders 94, 96 which are abuttable to the shoulders 84, 86 on the graspable knob 34 at both extremes of travel of the mounting plate 36 relative to the graspable knob 34.

To assemble the first part 122, the first movable element 30 is directed into a receptacle 98 defined by the shroud, through an end opening 100 through a base wall 102 of the shroud, through a central opening 104 through the mounting plate 36, through the center of the spring 38 and into the receptacle 46 until the snap fit connection between the first movable element 30 and graspable knob 34 is established. With the first part 22 in the assembled state, a head 106 at the free end thereof projects from the shroud 40 to expose diametrically opposite, spiral cam surfaces 108, 110, which cooperate with the second movable element 38 as described hereinbelow.

The second part 26, as seen most clearly in FIGS. 2 and 6–10, may utilize the graspable knob 34, torsion spring 38, and mounting plate 36, as described above, or may utilize corresponding elements having a different structure. The primary difference between the first part 22 and second part 26 lies in the configuration of the second movable element 32. The second movable element 32 has an end 112 that is bifurcated to define legs 114, 116, corresponding to the legs 42, 44, previously described. The legs 114, 116 snap into the receptacle 46 and are maintained therewithin in the same manner as the legs 42, 44 are maintained in the receptacle 46. With the end 112 fully inserted into the receptacle 46, an annular shoulder 118 on the second movable element 32 captively maintains the mounting plate 36 against the annular edge 68 of the graspable knob 34. With this arrangement, the graspable knob 34 and second movable element 32 move as one piece around a central axis 120 that is coincident with the central axis 62 with the first and second parts 22, 26 operatively connected as in FIG. 2.

The second movable element 32 has a receptacle 122 for the head 106 of the first movable element 30. The leading portion of the receptacle 122 is defined by a guide surface 124 having a diameter which increases progressively from a free edge 126 toward the graspable knob 34. The tapered guide surface 124 terminates inwardly at a surface portion 128 having a substantially uniform diameter. At the end of the surface portion 128 diametrically opposite cam elements 130, 132 are located. Each cam element 130, 132 has a rounded outer surface 134, 136 with apexes 138, 140 defining straight, parallel edges that are spaced from each other a distance X (FIG. 9).

Figure 2:
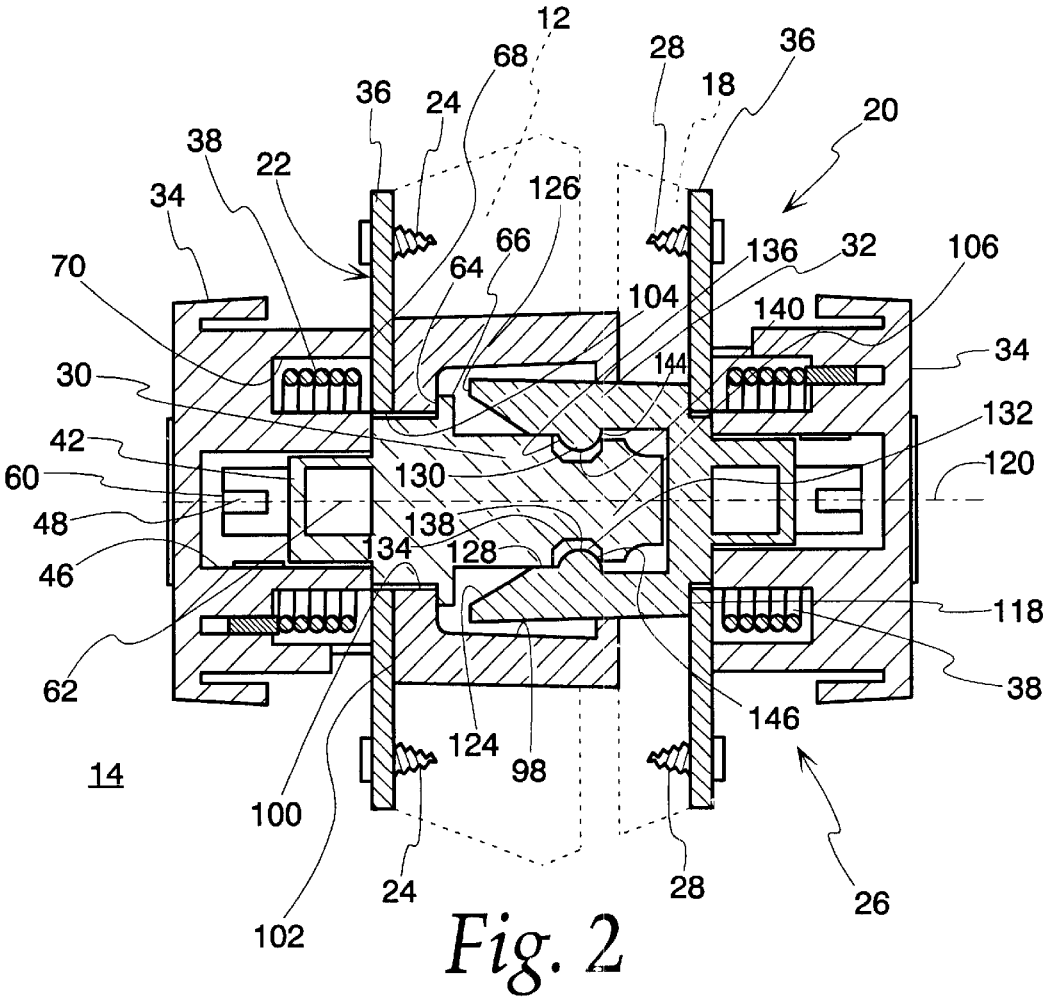
FIG. 2 is a cross-sectional view of the inventive holding assembly with a first part thereof connected to a support on the vehicle of FIG. 1 and a second part thereof connected to the closure element and with the closure element maintained by the holding assembly in the open position.
Figure 3:
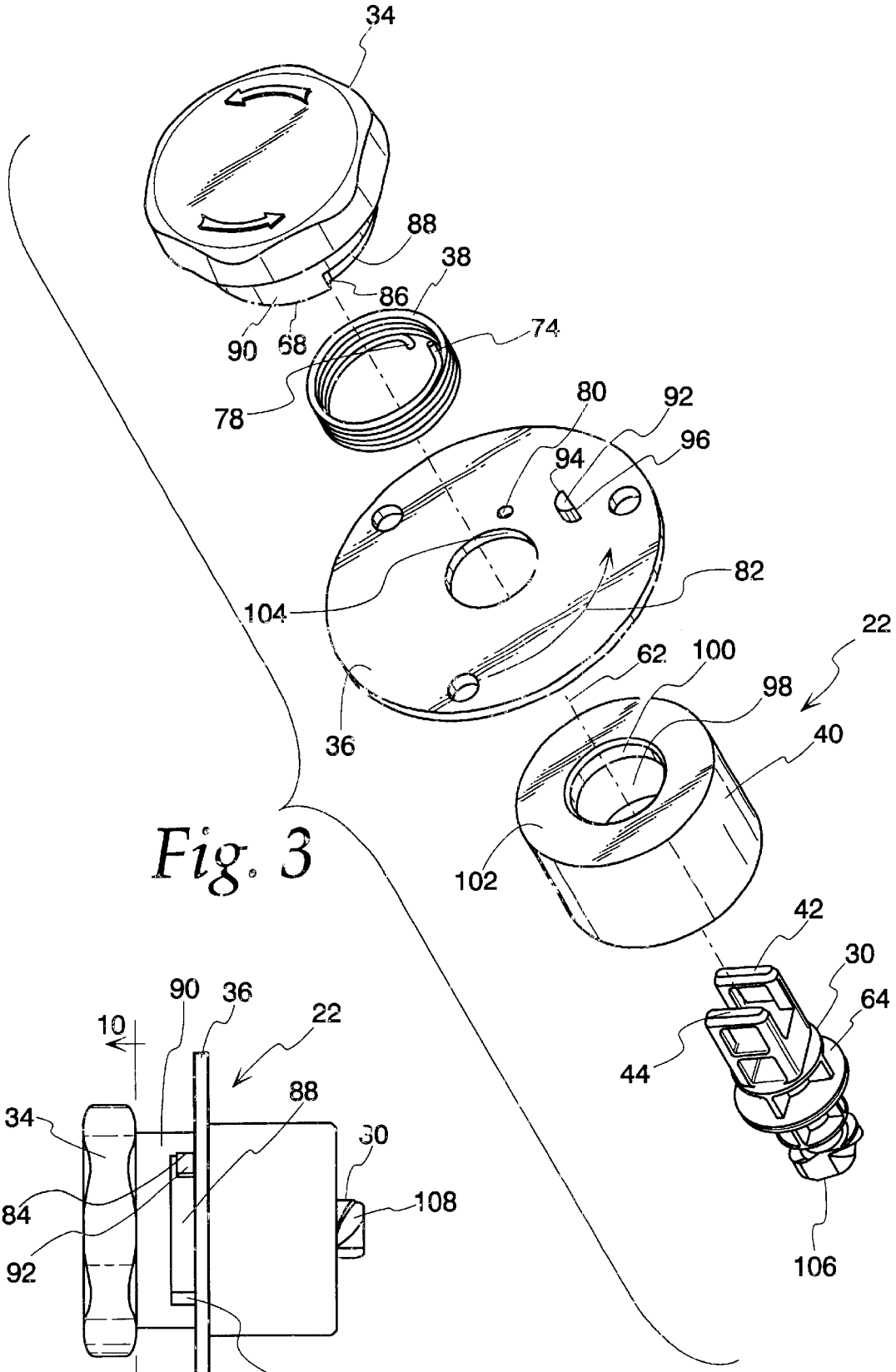
FIG. 3 is an exploded perspective view of the first part of the inventive holding assembly.
Figure 4:
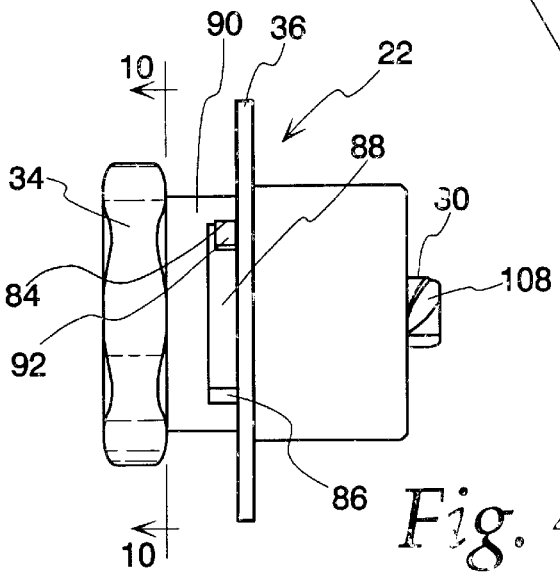
FIG. 4. is an elevation view of the first part of the holding assembly in an assembled state.
Figure 5:
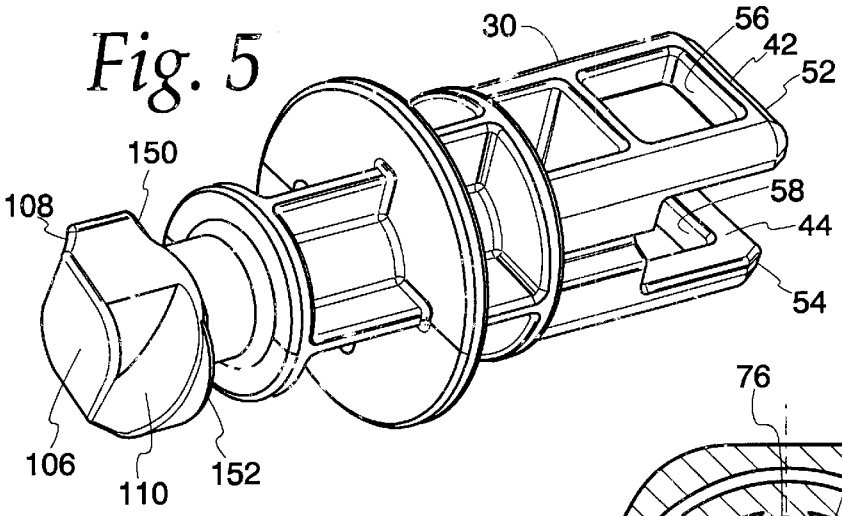
FIG. 5 is an enlarged, perspective view of a movable first element on the first holding assembly part.
Figure 10:
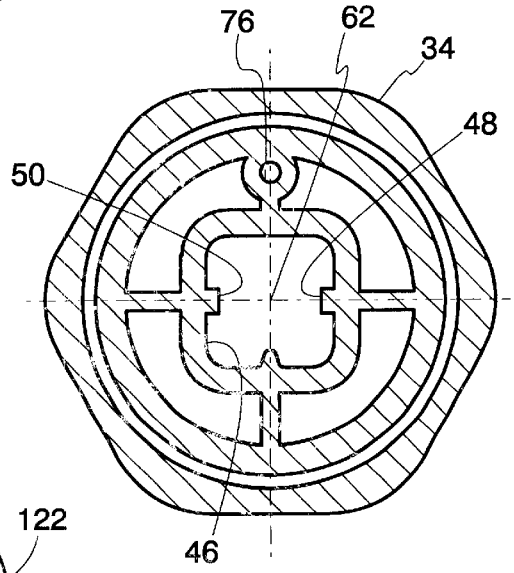
FIG. 10 is an enlarged, cross-sectional view of a knob used to turn each of the first and second elements of FIGS. 5 and 8 and taken along line 10—10 of FIG. 4.
Figure 8:
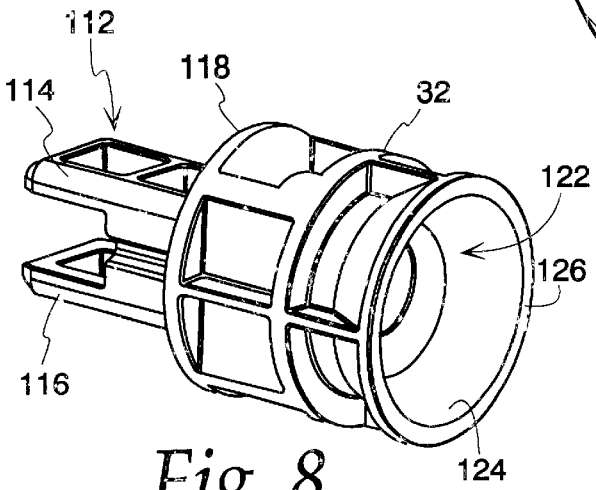
FIG. 8 is an enlarged, perspective view of a second movable element on the second part of the holding assembly which cooperates with the first element of FIG. 5 to releasably maintain the first and second parts together.
Figure 9:
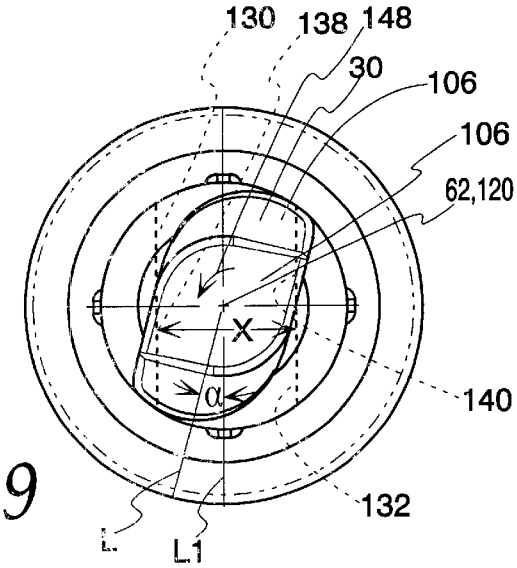
FIG. 9 is an enlarged, end view of the first movable element of FIG. 5 in relationship to the part of the second movable element in FIG. 8 with the first and second movable elements in a holding position.
Figure 6:
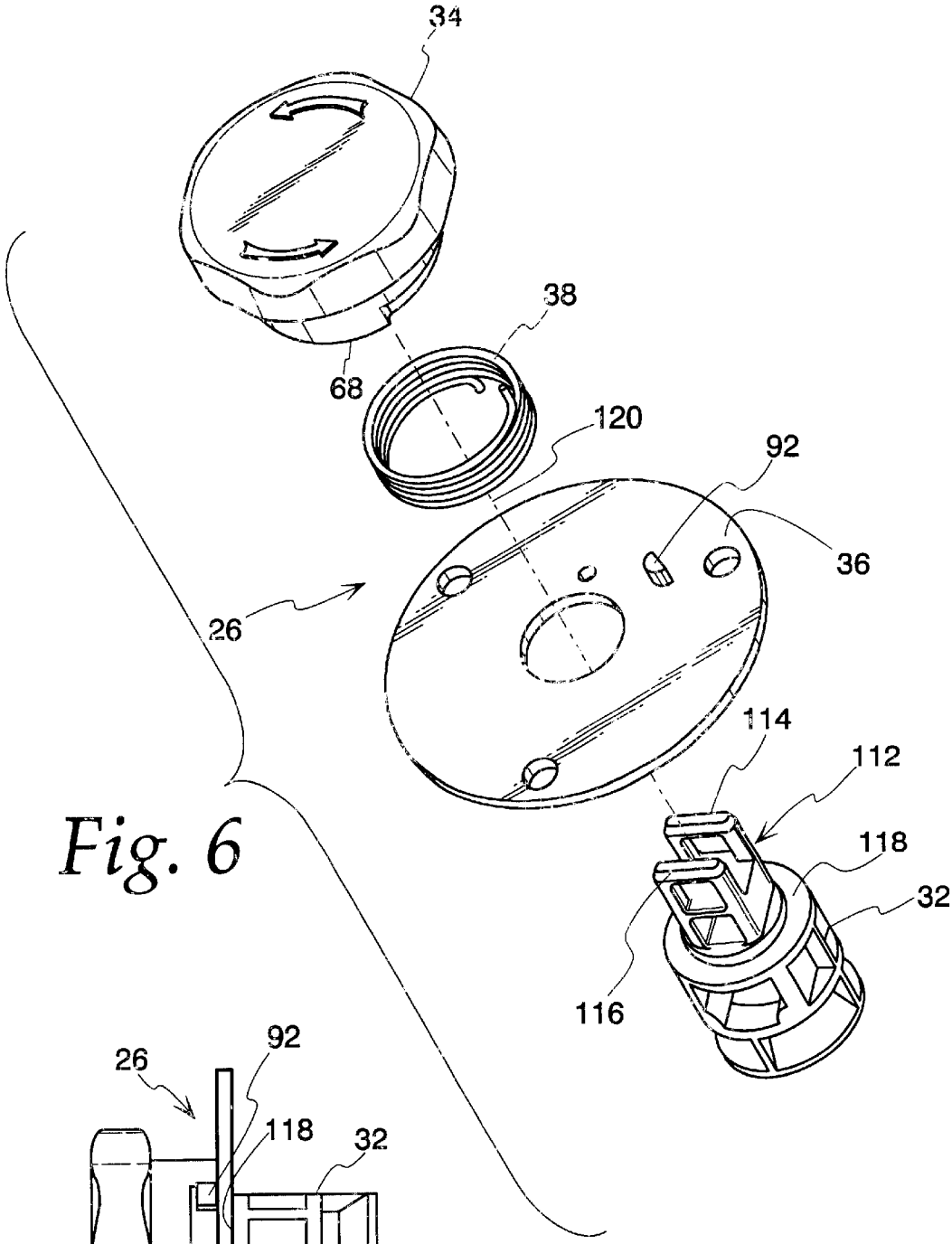
FIG. 6 is an exploded perspective view of the second part of the inventive holding assembly.
Figure 7:
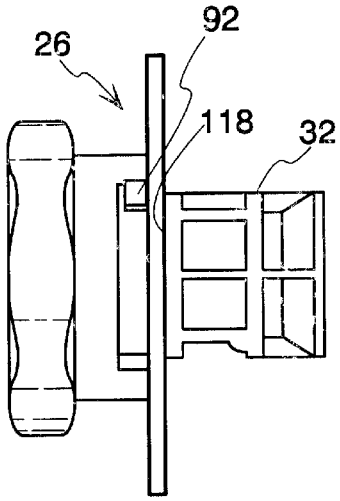
FIG. 7 is an elevation view of the second part of the holding assembly in an assembled state.

As seen particularly in FIG. 9, the end profile of the head 106 approximates a rectangular shape with a shorter dimension slightly less than the width X. Accordingly, the head 106 is allowed to pass fully through and past edges 144, 146 at the end of the surfaces 134, 136, as shown in FIG. 2.

The first and second parts 22, 26 are mounted in the frame/support 12 and closure element 18 so that as the closure element 18 is moved towards the open position, the head 106 is presented to the second movable element 32 in the orientation shown in FIG. 9. That is, a line L, which bisects the width of the head 106, is disposed at a slight angle $\alpha$ to a line L1 which bisects the width X. Accordingly, as the closure element 18 moves towards the open position, the cam surfaces 108, 110 on the head 106 are caused to encounter the rounded surfaces 134, 136 on the cam elements 130, 132. Continued movement of the closure element 18 towards the open position causes the surfaces 108, 110 to coact with the surfaces 134, 136 to cause the first movable element 30 to be urged in the direction of the arrow 148 around the axes 62, 120 and the second movable element 32 to be urged in a direction oppositely to that indicated by the arrow 148, around the axes 62, 120. Eventually, the first and second movable elements 30, 32 are relatively pivoted so that the head 106 is allowed to pass beyond the cam elements 130, 132, whereupon a first and second mounting element 30, 32 are allowed to relatively pivot under the force of their respective torsion springs 38 back toward the relative position shown in FIG. 9. In this position, diametrically oppositely located, axially facing edges 150, 152 abut to the edges 144, 146 of the cam elements 130, 132 to prevent the first and second parts 22, 26 from being axially separated. In this state, the first and second movable elements 30, 32, are in a holding position.

By turning either of the first and second movable elements 30, 32 through its graspable knob 34, the movable elements 30, 32 can be relatively situated to a release position wherein the head 106 is allowed to pass between the cam elements 130, 132 so as to allow the closure element 18 to be moved from the open position towards the closed position therefor.

The graspable knob 34 on the second part 26 can be conveniently manipulated by an operator situated on a step 154 on the vehicle 10 with the closure element 18 in the open position. Alternatively, the same release action can be imparted by operating the graspable knob 34 from within the compartment 14. Thus, a potentially positive, releasable holding force can be maintained between the frame/support 12 and the closure element 18 while allowing release of the holding force from either of two locations.

The foregoing disclosure of specific embodiments is intended to be illustrative of the broad concepts comprehended by the invention.

What is claimed is:

1. An assembly for releasably holding a movable closure element in a desired position relative to a support, said holding assembly comprising:

a first part comprising a first element and a first actuator, the first part being connectable to a closure element; and a second part comprising a second element and a second actuator, the second part being connectable to a support relative to which a closure element to which the first part is connected is movable, at least one of the first and second elements being movable relative to a support and/or closure element to which the at least one of the first and second elements is connected to allow the first and second elements to act one against the other so that the first and second elements realize a holding position as a closure element to which the first part is connected is moved towards and into the desired position, the first actuator being operable to move the at least one of the first and second elements relative to a support and/or closure element to which the at least one of the first and second elements is connected to a release position wherein a closure element to which the first part is connected can be moved from the desired position, the second actuator being operable to move the at least one of the first and second elements relative to a support and/or closure element to which the at least one of the first and second elements is connected to the release position wherein a closure element to which the first part is connected can be moved from the desired position.

2. The holding assembly according to claim 1 wherein the first actuator comprises a first graspable knob that is pivotable about a first axis relative to a closure element on which the first part is connected to move the first element from the holding position to the release position.

3. The holding assembly according to claim 2 wherein the first graspable knob and first element are pivotable as one piece around the first axis relative to a closure element to which the first part is connected.

4. The holding assembly according to claim 2 wherein the first element is biasably urged towards the holding position.

5. The holding assembly according to claim 4 wherein the first part further comprises a first mounting plate which is fixedly attachable to a closure and there is a spring which acts between the first mounting plate to bias the first element and first element towards the holding position.

6. The holding assembly according to claim 5 wherein there is a first shoulder on the first knob and a second shoulder on the first mounting plate, and the first and second shoulders cooperate to limit relative pivoting between the first knob and first mounting plate.

7. The holding assembly according to claim 6 wherein the first knob has an undercut that defines the first shoulder.

8. The holding assembly according to claim 2 wherein the second actuator comprises a second graspable knob that is pivotable about an axis that is coincident with the first axis with a closure element to which the first part is connected in the desired position.

9. The holding assembly according to claim 8 wherein one of the first and second elements comprises a spiral cam surface extending around the first axis with a closure element to which the first part is connected in the desired position.

10. The holding assembly according to claim 8 wherein with a closure element to which the first part is connected in the desired position the first element has a first shoulder facing axially relative to the first axis, the second element has a second shoulder facing axially relative to the first axis and oppositely to the first shoulder, and with the first and second elements in the holding position the first and second shoulders are abuttable to each other to limit relative axial movement of the first and second elements away from each other.

11. The holding assembly according to claim 10 wherein there is a first cam surface on the first element and a second cam surface on the second element and the first and second cam surfaces cooperate as a closure element to which the first part is connected moves towards the desired position to pivot at least one of the first and second elements about an axis so that the first and second elements are relatively positioned to allow the first and second shoulders to move past each other.

12. The holding assembly according to claim 1 further comprising a guide element on one of the first and second parts for guiding the one of the first and second elements on the other of the first and second parts on the other of the first and second elements against the other of the first and second elements on the one of the first and second parts.

13. The holding assembly according to claim 12 wherein the guide element has an annular portion.

14. The holding assembly according to claim 13 wherein the annular portion comprises a tapered guide surface.

15. The holding assembly according to claim 1 wherein the second actuator comprises a graspable knob that is pivotable about a first axis to move the second element from the holding position to the release position.

16. The holding assembly according to claim 15 wherein the graspable knob and second element are pivotable as one piece around the first axis relative to a support to which the second part is connected.

17. An assembly for releasably holding a movable closure element in a desired position relative to a support, said holding assembly comprising:

a first part comprising a first element and a first actuator, the first part being connectable to a closure element;

a second part comprising a second element and a second actuator, the second part being connectable to a support relative to which a closure element to which the first part is connected is movable, at least one of the first and second elements being movable relative to a support and/or closure element to which the at least one of the first and second elements is connected to allow the first and second elements to realize a holding position, the first actuator being operable to move the at least one of the first and second elements relative to a support and/or closure element to which the at least one of the first and second elements is connected to a release position wherein a closure element to which the first part is connected can be moved from the desired position, the second actuator being operable to move the at least one of the first and second elements relative to a support and/or closure element to which the at least one of the first and second elements is connected to the release position wherein a closure element to which the first part is connected can be moved from the desired position.

18. The holding assembly according to claim 17 wherein the first and second actuators each comprise a graspable knob that is pivotable about an axis.

19. In combination:

a support;

a closure element that is selectively movable relative to the support between a closed position and an open position; and a holding assembly comprising:

a first part comprising a first element and a first actuator, the first part being connected to a closure element; and a second part comprising a second element and a second actuator, the second part connected to the support, at least one of the first and second elements being movable relative to the support and/or closure element to allow the first and second elements to act, one against the other, so that the first and second elements realize a holding position as the closure is moved towards and into the open position, the first actuator being operable to move the at least one of the first and second elements relative to the support and/or closure element to a release position wherein the closure element can be moved from the open position towards the closed position, the second actuator being operable to move the at least one of the first and second elements relative to the support and/or closure element to the release position wherein the closure element can be moved from the open position towards the closed position.

20. The combination according to claim 19 wherein the first and second actuators each comprise a graspable knob that is pivotable about an axis.

* * * * *